United States Patent [19]

Myers et al.

[11] 4,267,890

[45] May 19, 1981

[54] FIRE EXTINGUISHING SYSTEM INCLUDING SENSOR COMPARABLE TO DETERMINE CHARGE

[75] Inventors: Jimmy D. Myers, Morton; Lawrence F. Fratzke, East Peoria, both of Ill.

[73] Assignee: Caterpillar Tractor Co., Peoria, Ill.

[21] Appl. No.: 149,193

[22] Filed: May 12, 1980

Related U.S. Application Data

[63] Continuation of Ser. No. 8,982, Feb. 5, 1979, abandoned.

[51] Int. Cl.[3] ..... A62C 23/08

[52] U.S. Cl. ..... 169/75; 73/345; 73/363.7

[58] Field of Search ..... 169/71, 75; 239/71; 116/266; 222/23, 29; 73/344, 345, 714, 363.7, 363.9

[56] References Cited

U.S. PATENT DOCUMENTS

| | | | |
|---|---|---|---|
| 2,239,221 | 4/1941 | Dimmock | 73/345 |
| 2,655,219 | 10/1953 | Ensminger | 169/11 X |
| 3,088,522 | 5/1963 | Zellner | 169/75 X |
| 3,209,595 | 10/1965 | Harland | 73/345 |
| 3,330,158 | 7/1967 | Simonyan et al. | 73/345 X |
| 3,610,208 | 10/1971 | Penning | 73/345 X |

*Primary Examiner*—Robert J. Spar
*Assistant Examiner*—Fred A. Silverberg
*Attorney, Agent, or Firm*—Wegner, Stellman, McCord, Wiles & Wood

[57] ABSTRACT

A fire extinguishing system including a pressure vessel (10) adapted to contain under pressure a fire extinguishing material, an outlet (12, 14, 16) connected to the vessel and selectively operable to release extinguishing material therefrom, and a pressure sensing device (18) in fluid communication with the interior of the vessel. The invention contemplates the improvement wherein a temperature sensing device (26) is in proximity to the vessel for determining the temperature in the environment of the vessel and that the scale (24) of the pressure sensing device is scaled in temperature units. The temperature sensing device and the scale (24) are so correlated that a visual comparison of the two will indicate whether the vessel is properly charged at any of a set of widely fluctuating ambient temperatures.

7 Claims, 3 Drawing Figures

FIRE EXTINGUISHING SYSTEM INCLUDING SENSOR COMPARABLE TO DETERMINE CHARGE

This is a continuation of application Ser. No. 008,982 filed Feb. 5, 1979, and now abandoned.

TECHNICAL FIELD

This invention relates to fire extinguishing systems and, more particularly, to indicators in such systems whereby the charge of fire extinguishing material in the system can be readily ascertained.

BACKGROUND ART

Many fire extinguishing systems in use today utilize pressure vessels which are charged with some predetermined weight of a nonsolid fire extinguishing material. When the system outlet is opened, the fire extinguishing material is expelled therefrom under pressure.

Of course, in order to be effective, it is necessary that the system contain, at all times, some predetermined minimum quantity of the fire extinguishing material. In most locations, periodic inspections of the system are made and, at least in the case of portable fire extinguishing systems, the most accurate way of ascertaining whether the system is properly charged is simply to weigh the pressure vessel comprising the extinguisher. In the usual case, the weight of the empty pressure vessel and appurtenances thereto is stamped on the vessel along with the weight of extinguishing material the vessel is to contain. If the weight of the extinguisher does not equal or exceed the desired total, the extinguisher must be recharged in order to meet minimum requirements.

This method of checking is, as mentioned, quite accurate and most likely should be performed periodically regardless of what other measures may be utilized to ascertain whether the charge is at or above minimum requirements. However, it is time-consuming in that it requires transportation of specialized equipment to the extinguisher site to provide for accurate weighing or, in the alternative the movement of the extinguisher to the site of a suitable scale. And, in between periodic inspections there is always the possibility that leakage will occur and/or the extinguisher actually used depeleting its charge, in whole or in part, without being recharged. As a consequence, if a need for the extinguisher arises after such occurrences and before the next inspection, the charge may be insufficient with the result that a fire may not be brought satisfactorily under control.

To alleviate this problem, the prior art has proposed the use of pressure sensing devices in fluid communication with the interior of the pressure vessel for sensing either the pressure of the extinguishing material therein, the pressure of the compressed gas within the vessel utilized to drive the material from the vessel when the vessel is opened, or a combination of both. In some instances where the fire extinguishing material is of the so-called "dry chemical" type, where only a compressed gas pressure is sensed, this worked quite well. However, in other cases, where a nonsolid fire extinguishing material is utilized, and where that material has a vapor pressure that fluctuates widely with temperature, pressure sensing alone is insufficient.

For example, a fire extinguisher normally placed within, say, the engine compartment of a vehicle or a power plant, may reach a temperature of 140° F. or more because of the heat generated within its environment. But this, in turn, will result in a high pressure indication on a pressure gauge which may show to be in a fully charged range on the gauge whereas if the extinguisher were exposed to more typical ambient temperatures, say, 70° F., there would be a clear indication of insufficient pressurization of charge.

To avoid the inaccuracies inherent in pure pressure indications, the prior art has also resorted to the use of pressure gauges which sense the pressure of the interior of the vessel and indicate the same on a scale in both pressure and temperature units. A person inspecting the gauge of such an extinguisher might observe, for example, an indication of 350 psig and a temperature of 70° F. If the observer believes the ambient temperature to be approximately 70° F., he can be assured that the extinguisher is properly charged. However, if at that time, he believes the ambient temperature to be 90° F., because the temperature reading on the pressure gauge is only 70° F., he may deduce that the extinguisher is undercharged.

This system represents an improvement over pure pressure readings, but is also suspect in that it requires a subjective decision on the part of the observer; he must properly estimate the ambient temperature.

Such estimates, in many cases, may be fairly reliable. However, reverting to the example of a fire extinguisher housed in the engine compartment of a vehicle, the observer has no accurate way of estimating the temperature within such a housing and may miss in his estimate by many tens of degrees F. The problem is compounded in that the usual human observer seldom encounters ambient temperatures much in excess of 100° F. and therefore will have very little experience in accurately estimating temperatures that are appreciably higher.

DISCLOSURE OF INVENTION

In one aspect of the present invention there is provided a fire extinguishing system including a pressure vessel adapted to contain under pressure a fire extinguishing material. Means are connected to the vessel and are selectively openable to release the pressurized material therefrom. A pressure sensing device is in fluid communication with the interior or the vessel and has a scaled visual indicator. The invention contemplates the improvement including a temperature sensing device in proximity to the vessel for determining the temperature in the environment of the vessel. The temperature sensing device has a scaled visual indicator and both scaled visual indicators are scaled in the same units, either pressure or temperature. The two scales are so correlated that a visual comparison of the two will indicate whether the system is properly charged at any of a set of widely fluctuating ambient temperatures.

Thus, an observer by comparing, for example, temperature readings on both the pressure sensor and the temperature sensor and observing their approximate identity, can ascertain that the system is properly charged whereas observance of a disparity between the two will inform the observer that the system is either under or over charged.

BEST MODE FOR CARRYING OUT THE INVENTION

Figure 1:
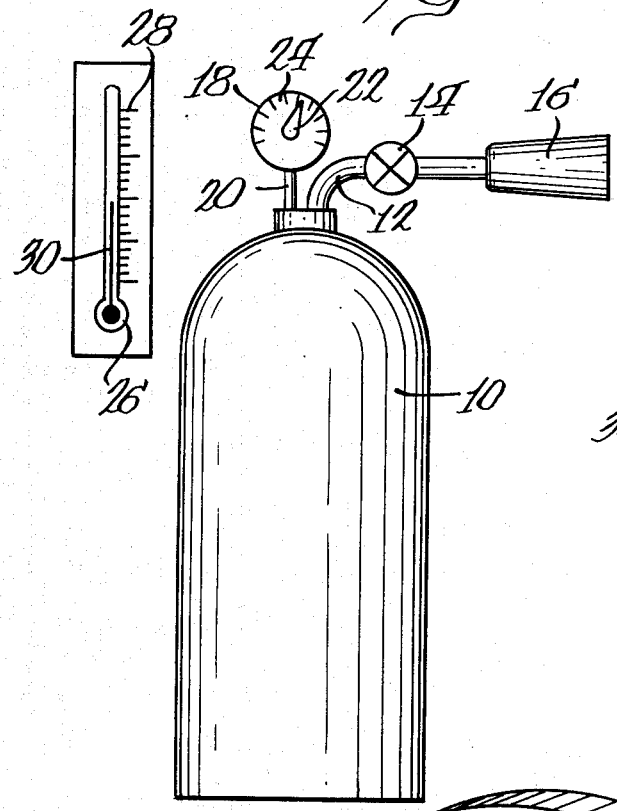
FIG. 1 is a side elevation of one embodiment of a fire extinguishing system made according to the invention.

An exemplary embodiment of a fire extinguishing system made according to the invention is illustrated in FIG. 1 in the form of a portable fire extinguisher. However, it is to be understood that the invention is not limited to portable extinguishers, but may be used with efficacy in any fire extinguishing system wherein fire extinguishing material is contained within a pressurized vessel and the nature of the fire extinguishing agent and/or any pressurizing agent used in connection therewith is such that pressure will fluctuate widely with varying temperature.

As seen in FIG. 1, the system includes a pressure vessel 10 which contains a suitable fire extinguishing agent (not shown). The vessel 10 includes an outlet hose 12 provided with a valve 14 for controlling the flow of fire extinguishing agent from the vessel, under pressure, to the usual nozzle 16 which may be aimed at a fire to be extinguished. The contents of the vessel 10 may be expelled from the same when the valve 14 is open either by the vapor pressure with the bottle of the fire extinguisher material itself, a compressed gas placed within the vessel 10 for the purpose of urging material out of the vessel 10, or a combination of both.

The fire extinguisher further includes a pressure sensing gauge 18 having an inlet port 20 in fluid communication with the interior of the vessel and a movable, visual indicator 22 whose position with respect to a scale 24 will vary dependent upon the pressure within the vessel 10.

The general organization of the system is completed by a thermometer 26 in close proximity to the vessel 10 so as to be exposed to the same ambient temperature as the vessel 10 when the latter is placed in its desired location. Typically, the thermometer 26 may be mounted directly to the vessel 10 by means not shown. The thermometer 26 also includes a scale 28 and a movable indicator 30, shown as a column of fluid, which moves relative to the scale 28.

According to the invention, the scales 24 and 28 are scaled in the same units, that is, either temperature or pressure. For example, if it is determined that the scale 24 of the pressure gauge 18 be calibrated in pounds per square inch, then the scale 28 will also read in pounds per square inch rather than in temperature units. Conversely, and in a preferred embodiment, the scale 28 will be designated in temperature units such as degrees Fahrenheit and in such a case, the scale 24 will also be calibrated in temperature units as degrees Fahrenheit.

Figure 2:
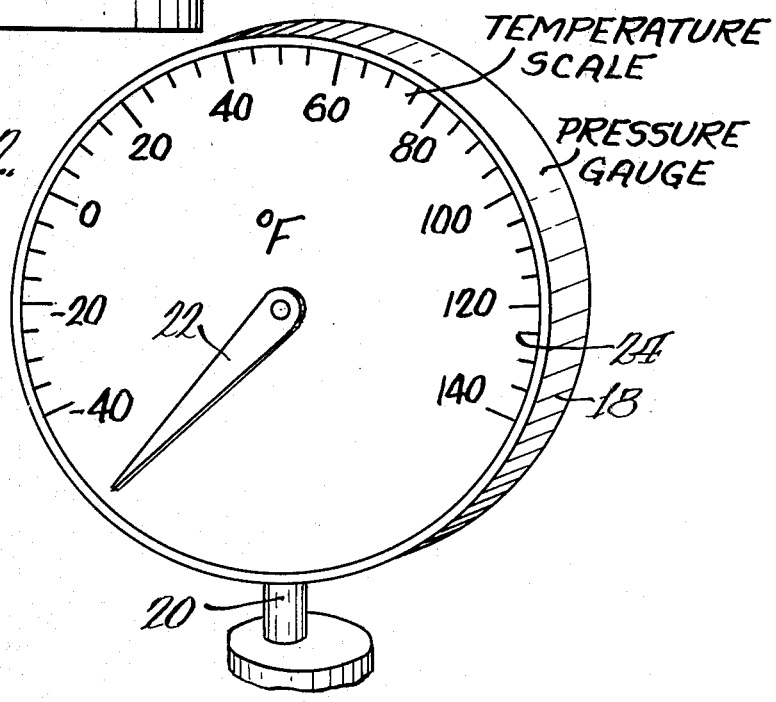
FIG. 2 is an enlarged view of an indicator used in the embodiment of FIG. 1.

The range of both scales will be that range of ambient temperatures which is expected to encompass all ambient temperature conditions that might be encountered by the fire extinguisher in use. Thus, FIG. 2 shows, for example, a range extending from −40° to 140° F.

If both scales 24 and 28 are configured in pressure units, then the range would be selected to be that range of pressures that would exist within the vessel 10, when charged to some predetermined minimum value, that would be present over the temperature range to which the extinguisher might be subject when in use.

The scales 24 and 28 are correlated. The following table indicates 10 degree Fahrenheit temperature increments from −40° to 150° and corresponding pressure in pounds per square inch of a typical fire extinguisher charged with fifteen pounds of the fire extinguishing material sold under the registered trademark Halon® 1301 and an inert gas such as nitrogen to a pressure of about 365 pounds per square inch at 80° Fahrenheit.

HALON 1301
PRESSURE VS. TEMPERATURE DATA

| TEMPERATURE F. | PRESSURE psig |
|---|---|
| −40 | 123.7 |
| −30 | 134.0 |
| −20 | 145.6 |
| −10 | 158.6 |
| 0 | 173.2 |
| 10 | 189.6 |
| 20 | 207.8 |
| 30 | 228.1 |
| 40 | 250.5 |
| 50 | 275.4 |
| 60 | 302.8 |
| 70 | 332.9 |
| 80 | 365.9 |
| 90 | 402.1 |
| 100 | 441.8 |
| 110 | 485.1 |
| 120 | 532.4 |
| 130 | 584.4 |
| 140 | 642.3 |
| 150 | 716.9 |

To properly correlate the scales 24 and 28, the following is done. If it be assumed that temperature units are being employed on both, then the usual temperature units found on the scale 28 may remain intact without change. At the point on the scale 24 of the pressure sensor 18 corresponding to a reading of 123.7 pounds per square inch, the temperature designation of −40° F. would be placed. At the 134 pounds per square inch point on the scale 24, the temperature designation of −30° F. would be placed. This procedure is continued so that at the point on the scale 24 corresponding to a 716.9 pounds per square inch designation, there would be placed a 150° F. temperature indication.

Of course, if both scales 24 and 28 are to be in pressure units, the pressure scale 24 of the original pressure sensor 18 is left intact while the temperature scale 28 would be altered so that at 40° F. point thereon, the pressure designation of 123.7 pounds per square inch is placed. At the minus −30° F. location, the pressure designation of 134 pounds per square inch would be placed, etc.

Ascertainment of the proper charge is accomplished as follows. Assuming temperature units are used on both scales, the observer need only observe the temperature reading on the pressure sensor 18 and compare that with the temperature reading on the thermometer 26, or vice versa. If the two are the same, the observer is assured that the extinguisher 10 has its minimum charge therein. Conversely, if the temperature reading on the pressure sensor 18 is less than that on the thermometer 26, the observer knows that the charge in the extinguisher 10 is less than the determined minimum either through leakage or through partial, but intentional discharge without recharging. If the temperature reading on the pressure sensor 18 is greater than that on the thermometer 26, the observer is informed that the charge contained within the extinguisher 10 is greater than minimum charging requirement.

Figure 3:
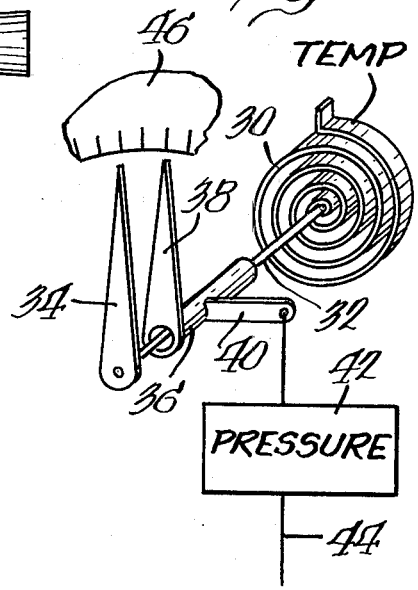
FIG. 3 is a fragmentary, somewhat schematic, perspective view of part of a modified embodiment of the invention.

FIG. 3 illustrates a modified embodiment of the invention including a temperature sensing device in the form of a coiled bimetal 30 connected by a rod 32 to a rotatable needle or indicator 34. A tube 36 is coaxially disposed about the rod 32 so as to be relatively rotatable with respect thereto and mounts a similar needle 38. An arm 40 is secured to the sleeve 36 and is connected to a conventional pressure sensing mechanism 42 which in turn includes an inlet port 44 in fluid communication with the interior of a fire extinguisher such as the bottle 10. Through suitable adjustment of the bimetal 30, the innards 42 of the pressure sensing device, or both, the same can be correlated so that the needles 34 and 38 will be aligned with each other for all ambient temperatures when the desired minimum fill of extinguishing material remains in the extinguisher 10. Misalignment of the needles 34 and 38 then provides an indication of over or under filling of the extinguisher. Of course, if desired, rather than needles, apertured masks or a combination of an apertured mask and a needle may be used in lieu thereof along with highly visible color coding on one or the other of the components which is uncovered to indicate an underfilled condition.

If desired, a scale 46 may also be used to obtain pressure readings or the like.

INDUSTRIAL APPLICABILITY

Fire extinguishing systems made according to the invention are ideally suited for use where the system is subjected to widely fluctuating ambient temperatures. For example, where a fire extinguisher is to be stored in the engine compartment of a vehicle, in cold climes, temperature conditions of −40° F. may be frequently encountered and the compartment will be at such a temperature when the engine has not been utilized for a period of time. A reading of the indicators of the invention will provide an accurate indication of the fill of the extinguisher under such a condition.

And assuming the same outdoor temperature exists after the engine has been running for an extended period, the engine compartment may reach an elevated temperature of 100° or 120° F. Not withstanding the cold outdoor temperature, the indicators of the present invention will still provide an accurate indication of the degree of fill of the extinguisher.

Other applications will be readily apparent and, for example, include fire extinguishing systems used in commercial kitchens, food processing operations involving smoking or cooking, etc.

What is claimed is:

1. In a fire extinguishing system including a pressure vessel (10) adapted to contain under pressure a fire extinguishing material, means (12,14,16) connected to said vessel and selectively operable to release the pressurized fire extinguishing material therefrom, a pressure sensing device (42) in fluid communication with the interior of said vessel and having a visual indicator (38) and a temperature sensing device (30) mounted in fixed association with said vessel for determining the temperatures in the environment of said vessel and having a visual indicator (34), the improvement comprising the provision of a single scale (46) associated with said visual indicators providing a visual comparison of the two visual indicators to indicate whether the system is properly charged over a wide range of ambient temperatures, said first indicator indicating the pressure sensed by said pressure sensing device and said second indicator indicating the temperature sensed by said temperature sensing device, said visual indicators comprising needles mounted for rotation about a single axis.

2. In a fire extinguishing system including a pressure vessel (10) adapted to contain under pressure a fire extinguishing material, means (12,14,16) connected to said vessel and selectively operable to release the pressurized fire extinguishing material therefrom, a pressure sensing device (42) in fluid communication with the interior of said vessel and having a visual indicator (38) and a temperature sensing device (30) mounted in fixed association with said vessel for determining the temperatures in the environment of said vessel and having a visual indicator (34), the improvement comprising the provision of a single scale (46) associated with said visual indicators providing a visual comparison of the two visual indicators to indicate whether the system is properly charged over a wide range of ambient temperatures, said first indicator indicating the pressure sensed by said pressure sensing device and said second indicator indicating the temperature sensed by said temperature sensing device, said visual indicators comprising needles disposed adjacent said scale.

3. In a fire extinguishing system including a pressure vessel (10) adapted to contain under pressure a fire extinguishing material, means (12,14,16) connected to said vessel and selectively operable to release the pressurized fire extinguishing material therefrom, the improvement comprising:

a first indicator needle;

a second indicator needle;

means for adjustably positioning said first indicator needle as a function of the pressure of said fire extinguishing material; and means for adjustably positioning said second indicator needle adjacent said first indicator needle as a function of the temperature of said fire extinguishing material to cause said needles to be disposed in aligned relationship when the amount of fire extinguishing material is a preselected minimum amount over a wide range of ambient temperatures.

4. The fire extinguishing system of claim 3 wherein said indicator needles are mounted for rotation about a single axis.

5. The fire extinguishing system of claim 3 wherein said temperature sensing device comprises a coiled bimetal device.

6. The fire extinguishing system of claim 3 wherein said temperature sensing device comprises an adjustable bimetal device.

7. The fire extinguishing system of claim 3 further including a single scale, each of said indicator needles being disposed adjacent said scale.

* * * * *